United States Patent [19]

Penkunas et al.

[11] Patent Number: 4,886,638

[45] Date of Patent: Dec. 12, 1989

[54] METHOD FOR PRODUCING METAL CARBIDE GRADE POWDERS

[75] Inventors: Joseph J. Penkunas; Theodore E. Smith, both of Sayre; Jack L. Burwick, York, all of Pa.

[73] Assignee: GTE Products Corporation, Stamford, Conn.

[21] Appl. No.: 384,199

[22] Filed: Jul. 24, 1989

[51] Int. Cl.[4] ..... B22F 1/00

[52] U.S. Cl. ..... 419/15; 419/14; 419/33; 419/36; 419/37; 419/40; 75/0.5 BC

[58] Field of Search ..... 75/0.5 BC; 419/15, 14, 419/33, 36, 37, 40

[56] References Cited

U.S. PATENT DOCUMENTS

| | | | |
|---|---|---|---|
| 3,888,662 | 6/1975 | Boeckler | 419/14 |
| 3,964,878 | 6/1976 | Scheithauer et al. | 419/15 |
| 4,011,291 | 3/1977 | Curry | 419/37 |
| 4,497,559 | 1/1985 | Grab et al. | 419/36 |
| 4,554,130 | 11/1985 | Ecer | 419/36 |
| 4,630,692 | 12/1986 | Ecer | 419/36 |

*Primary Examiner*—Stephen J. Lechert, Jr.

[57] ABSTRACT

A method is disclosed for producing metal carbide grade powders, which comprises dry milling metal carbide powder which can be tungsten carbide, titanium carbide, tantalum carbide, niobium carbide, vanadium carbide, chromium carbide, and combinations thereof to increase the surface area of the powder particles to result in essetially all of the powders being converted to single crystals, forming a mixture of the resulting dry milled carbide powder, a binder metal which can be cobalt, nickel, and combinations thereof, and a wax, while heating the carbide powder, the binder metal and the wax to a temperature above the melting point of the wax and maintaining the temperature to result in a uniform distribution of the wax on the carbide and binder metal particles, forming a slurry of the mixture and water, attritor milling the slurry at a temperature below the melting point of the wax, and removing the water from the resulting attritor milled mixture and aggiomerating the mixture to produce the metal carbide grade powder wherein a densified article made therefrom exhibits essentially no pores that are greater than about 10 micrometers in diameter after sintering at from about 1350° C. to about 1540° C.

1 Claim, No Drawings

METHOD FOR PRODUCING METAL CARBIDE GRADE POWDERS

BACKGROUND OF THE INVENTION

This invention relates to a method for producing metal carbide grade powders in which the surface area of the powders is increased prior to application of the wax binder. This results in an even distribution of the wax binder on the powder particles. The grade powder product thus produced is essentially free of micropores, that is, pores which measure from about 10 to about 25 micrometers in diameter and essentially free of macropores, that is, pores greater than about 25 micrometers in diameter after sintering at a temperature of from about 1350° C. to about 1540° C.

In the production of metal carbide grade powders there is a problem of uneven distribution of the wax binder on the powder particle surfaces. The uneven distsribution results from the fact that in attritor milling of the powders with wax, new surface area is produced due to the comminution of the highly agglomerated and/or polycrystalline metal carbide starting material. The larger the starting particle size, the higher the proportion of new surface produced. The new surface cannot be readily coated with the wax additive blend during milling as the solid state of the wax and the polar nature of the water make the redistribution of the wax very unlikely. As a result, densified articles made from these powders exhibit porosity and void defects, which adversely affect the strength and wear properties of the article.

SUMMARY OF THE INVENTION

In accordance with one aspect of the invention, there is provided a method for producing metal carbide grade powders, which comprises dry milling metal carbide powder which can be tungsten carbide, titanium carbide, tantalum carbide, niobium carbide, vanadium carbide, chromium carbide, and combinations thereof to increase the surface area of the powder particles to result in essentially all of the powders being converted to single crystals, forming a mixture of the resulting dry milled carbide powder, a binder metal which can be cobalt, nickel, and combinations thereof, and a wax, while heating the carbide powder, the binder metal and the wax to a temperature above the melting point of the wax and maintaining the temperature to result in a uniform distribution of the wax on the carbide and binder metal particles, forming a slurry of the mixture and water, attritor milling the slurry at a temperature below the melting point of the wax, and removing the water from the resulting attritor milled mixture and agglomerating the mixture to produce the metal carbide grade powder wherein a densified article made therefrom exhibits essentially no pores that are greater than about 10 micrometers in diameter after sintering at from about 1350° C. to about 1540° C.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The present invention provides a method by which metal carbide grade powders can be produced. By grade powders is meant the carbide powder with a binder metal which is typically cobalt or nickel or combinations thereof. The metal carbides which are especially suited to the practice of the invention are tungsten carbide, titanium carbide, tantalum carbide, niobium carbide, vanadium carbide, chromium carbide, and combinations thereof.

Prior to the present invention the surface area of the metal carbide powder was not first increased and therefore it was increased in the attritor milling step. As a result even distribution of the wax on the particle surfaces during attritor milling was nearly impossible to achieve due to the poor mixing of the wax in the solid state with the water. It is believed that the active radical of the paraffin wax additive must attach itself to the powder surface in the molten state. The radical cannot rotate or reattach in a solid state or in a state when it is no longer active, that is, in which it has reacted or has been rendered neutral by forming hydrogen bonds with something other that the powder surface, such as water.

Densified articles made from the grade powders produced by the method of the present invention are essentially free of B type porosity and voids when sintered at from about 1350° C. to about 1540° C. This is not normally achieved when the grade powders are produced by the prior method of not increasing the surface area of the carbide powder prior to the attritor milling step. ASTM defines A porosity as holes up to about 10 micrometers in diameter and B porosity as from about 10 to about 25 micrometers in diameter, whereas macropores are greater than about 25 micrometers in diameter. The above described articles are essentially free of pores greater than about 10 micrometers in diameter. These properties are produced by a combination of milling operations by which the surface area of the starting metal carbide powders is increased to near-maximum, that is, from the polycrystalline state to essentially all single crystals. This is done prior to the powder-wax mixing step in which the wax is bound to the powders. In this way, minimum new surface area is produced in the attritor milling step and the wax is applied relatively uniformly to the powder particle surfaces. As a result of the even distribution of the wax on the carbide powder surfaces, the cobalt which is bound to the carbide by the wax is evenly distributed throughout the carbide. If the powder is not first dry milled followed by addition of the wax prior to attritor milling, much free wax is generated in the attritor milling step and it is this free wax that causes the microporsity and macroporosity defects. The method of the present invention will now be described.

The starting metal carbide is dry milled by conventional techniques such as dry ball milling to increase the surface area of the carbide. The milling time is typically from about 1 hour to about 12 hours and is determined by the mill loading parameters. The objective of this dry milling step is to achieve a high surface area as has been previously described, that would have been achieved in the subsequent attritor milling step as was done prior to the present invention.

A mixture is then formed of the resulting dry milled carbide powder, a binder metal which can be cobalt, nickel or combinations of these, and a wax. The wax serves as a lubricant or binder to bind the carbide particles to the metal binder particles. The wax is typically paraffinic, or esterified or acidic type. Typically about 98% by weight of the metal carbide and binder metal powder is mixed with about 2% by weight of the wax. The wax is typically a blend of about 60% to about 95% by weight paraffinic wax and the balance an esterified or acidic wax. The preferred paraffinic wax is refined having a melting point of from about 50° C. to about 55° C. A preferred esterified wax is beeswax and a preferred acid type wax is stearic acid. The mixture is formed at an elevated temperature, that is a temperature above the melting point of the wax and this temperature is maintained to insure that the wax is evenly distributed over the carbide and binder metal particles. Usually the carbide powder and the binder metal are mixed and then heated and then the wax is introduced. The wax is normally in flaked form. The mixing is done typically in a steam jacketed mixer. Mixing is carried out until the wax is completely melted and evenly distributed throughout the carbide and binder metal powders. After sufficient mixing time which depends on the type of equipment and the amount of material, the powder-wax mixture is cooled by closing off the steam lines and opening up the cold water lines. The mixer is allowed to operate during the cooling causing the powder-wax to remain as a fluffy powder and not clumps or chunks.

A slurry is then formed of the resulting carbide powder-binder metal-wax mixture and water. The slurry is typically about 80% by weight carbide powder-binder metal-wax mixture and the balance water.

The resulting slurry is then attritor milled. The water serves as the milling fluid. The milling time is sufficient to allow the complete mixing of the carbide, binder metal, and wax so that when a densified cemented carbide article is made from the resulting powder, the article exhibits essentially no B type porosity and essentially no macropores. The milling time is typically from about 2 hours to about 12 hours depending on mill loading parameters. The attritor milling insures uniform mixing of the carbide and metal powders and the wax. With the waxes already affixed to the carbide and binder metal, there is little or no wax separation from the carbide during milling as the aqueous slurry is maintained below the melting point of the wax phase.

After the attritor milling step, the water is removed from the attritor milled powder and wax mixture, and the mixture is agglomerated. This is done typically by spray drying the slurry. This removes the water and allows the carbide-binder metal-wax to form a spherical shape. The resulting dry spherical powder/wax grade mix agglomerates are then ready to be processed by conventional methods to produce densified articles therefrom. These methods involve generally formation of a green article, and thereafter removing the wax and sintering.

Since the wax does not separate from the powder during milling and drying and agglomerating, the incidence of porosity defects of the resulting articles attributed to uneven wax distribution is virtually eliminated.

To more fully illustrate this invention, the following nonlimiting example is presented.

EXAMPLE

About 10 kg of WC is ball milled in about 25 kg of milling media for about 4 hours. The milled WC is then mixed with about 0.64 kg of cobalt and about 0.217 kg of wax. The resulting WC-Co-wax mixture is heated to about 90° C. and held for about 20 minutes while being mixed. The mixture is then cooled to room temperature. The mixture is then attritor milled in water with about 45 kg of milling media for about 5 hours at about 200 rpm. The resulting attritor milled mixture is then spray dried to agglomerate it. The spray dried powder is then pressed into green articles which are then sintered at about 1440° C.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing metal carbide grade powders, said method comprising:

(a) dry milling metal carbide powder selected from the group consisting of tungsten carbide, titanium carbide, tantalum carbide, niobium carbide, vanadium carbide, chromium carbide, and combinations thereof to increase the surface area of the powder particles to result in essentially all of said powders being converted to single crystals;

(b) forming a mixture of the resulting dry milled carbide powder, a binder metal selected from the group consisting of cobalt, nickel, and combinations thereof, and a wax while heating said carbide powder, said binder metal and said wax to a temperature above the melting point of said wax and maintaining said temperature to result in a uniform distribution of said wax on said carbide and binder metal particles;

(c) forming a slurry of said mixture and water;

(d) attritor milling said slurry at a temperature below the melting point of said wax; and (e) removing the water from the resulting attritor milled mixture and agglomerating said mixture to produce said metal carbide grade powder wherein a densified article made therefrom exhibits essentially no pores that are greater than about 10 micrometers in diameter after sintering at from about 1350° C. to about 1540° C.

* * * * *